US005819960A

United States Patent [19]

Bonazza

[11] Patent Number: 5,819,960

[45] Date of Patent: Oct. 13, 1998

[54] HAIR COLORING EASEL

[75] Inventor: Claudio Bonazza, Mission Viejo, Calif.

[73] Assignee: Venice Trading Co., Inc., Costa Mesa, Calif.

[21] Appl. No.: 783,602

[22] Filed: Jan. 14, 1997

[51] Int. Cl.[6] ..... A47F 5/00

[52] U.S. Cl. ..... 211/133.1; 211/133.4; D28/73

[58] Field of Search ..... 132/208, 270; D28/73; 211/71.01, 74, 133.4, 205, 133.1, 72; 108/25, 26

[56] References Cited

U.S. PATENT DOCUMENTS

| | | | |
|---|---|---|---|
| D. 144,859 | 5/1946 | McKenzie | 108/25 X |
| D. 199,993 | 1/1965 | Cohen | 108/25 X |
| D. 375,580 | 11/1996 | Giedd | D28/73 |
| 3,601,443 | 8/1971 | Jones | 297/188 |
| 3,715,038 | 2/1973 | Winkler | 211/133.4 X |
| 4,164,287 | 8/1979 | Muller et al. | 211/72 X |
| 4,842,350 | 6/1989 | Collings | 211/74 X |
| 5,024,705 | 6/1991 | Cahill | 211/74 X |
| 5,141,117 | 8/1992 | Olsen et al. | 211/71.01 |
| 5,460,102 | 10/1995 | Pasmanick | 108/25 X |

OTHER PUBLICATIONS

"Give Your Salon Cart A Makeover," Salon Easel brochure, Salon Easel, Inc., 1996, (2 pgs.).

"Series 2000 Plus," color service trays advertising brochure, Dina Meri, 1995 (2 pgs.).

"106 Concorde," Brushing Service advertising brochure, Dina Meri, 1975 (1 pg.).

"Revolutionizing Salon Equipment," salon equipment advertising brochure, Verbiér, 1996 (1 pg.).

*Primary Examiner*—Robert W. Gibson, Jr.

*Attorney, Agent, or Firm*—Christie, Parker & Hale, LLP

[57] ABSTRACT

A hair coloring easel used by a hair stylist includes multiple hair coloring solution compartments and multiple foil holding compartments formed in a tray. The tray is coupled to a cart. The hair coloring solution compartments each hold a tint bowl for storing a hair coloring solution. The foil holding compartments each hold a foil material. The hair coloring solution and foil holding compartments are correlated as pairs according to their relative position and a reference indicia such as color.

16 Claims, 3 Drawing Sheets

21h
38
21c
21f
21d
21e
21g
20
21b
21a
14
16
10
14
12

28
20
30
26
24
22
36
32
34

39
41
43
44
38
48
42
40
46

HAIR COLORING EASEL

FIELD OF THE INVENTION

This invention relates generally to easels used as hair salon equipment and more specifically to an easel providing for correlation between multiple hair coloring solutions and associated foils.

BACKGROUND OF THE INVENTION

Easels are used in hair salons to hold various items required by a hair stylist when working on a customer's hair. These items include permanent solutions, hair coloring solutions, permanent rollers, combs, brushes, hair clips, foils, etc. Special compartments sized to hold these items exist in hair styling easels to allow the hair stylist ready access to the items when needed.

When coloring a customer's hair, a hair stylist applies a small quantity of hair coloring solution to a lock of the customer's hair and wraps it in foil. This step is repeated for as many portions of hair as are needed to color the customer's hair to obtain the desired result. As part of this process, the hair stylist obtains the hair coloring solution and pieces of foil from a tray on top of the easel. The hair stylist typically starts at a particular point on the customer's head and works methodically to cover the hair with hair coloring solution and foils, so as to result in an overall look of blended color for the entire head of hair.

Some customers desire to have their hair colored or highlighted with more than one color. In this case, multiple hair coloring solution bottles or bowls are needed, one for each hair color. All of these containers are stored on the easel. When applying the multiple solutions, it is difficult for the hair stylist to keep track of which foils have been applied along with different hair coloring solutions to ensure the even application of individual colors. If the application of the individual hair coloring solutions is not coordinated, an undesirable appearance may result. What is needed is an easel that helps the hair stylist to manage the application of multiple hair coloring solutions and to keep track of which coloring solutions have been applied to particular regions of a customer's hair.

SUMMARY OF THE INVENTION

One embodiment of the present invention provides a hair coloring easel, or cart, having a tray with a plurality of compartments for holding hair coloring solutions coordinated with a plurality of compartments for holding associated foils according to a predetermined indicia.

Additional advantages and novel features of the invention will be set forth in part in the description which follows, and will become apparent to those skilled in the art upon examination of the following, or may be learned by practice of the invention.

According to one embodiment of the present invention, the foregoing and other advantages are attained by a hair coloring easel having a base, a vertical support coupled to the base, and at least one tray coupled to the vertical support. The tray includes multiple hair coloring solution compartments and multiple foil holding compartments. Selected ones of the hair coloring solution compartments are correlated to selected ones of the foil holding compartments according to a predetermined indicia, such as color. The hair coloring solution compartments hold colored bowls of different hair coloring solutions. The foil holding compartments hold foil materials of colors matching the colors of corresponding bowls. Preferably, a brush or other implement for applying a hair coloring solution is also coordinated with each compartment for hair coloring solution and foil.

The present invention also provides a method of applying to a customer's hair a plurality of hair coloring solutions stored in a hair coloring easel, the hair coloring easel having multiple hair coloring solution compartments, each of which holds a colored tint bowl storing a selected hair coloring solution, and multiple foil holding compartments, each holding colored foil material, with the color of a selected tint bowl matching the color of a selected foil material. Preferably, individual tint brushes, color coordinated to a specific tint bowl, are also provided. The method comprises the steps of applying a first hair coloring solution to a first lock of the customer's hair from a first tint bowl having a first color, the first tint bowl being resident in a first hair coloring solution compartment; obtaining a first foil material having the first color from a first foil holding compartment correlated to the first hair coloring solution compartment; wrapping the first lock with the first foil material having the first color; applying a second hair coloring solution to a second lock of the customer's hair from a second tint bowl having a second color, the second tint bowl being resident in a second hair coloring solution compartment; obtaining a second foil material having the second color from a second foil holding compartment correlated to the second hair coloring solution compartment; wrapping the second lock with the second foil material having the second color; and continuing the process with zero or more additional hair coloring solutions, as desired by the stylist.

Still other objects and advantages of the present invention will become readily apparent to those skilled in the art from the following detailed description, wherein is shown and described only the preferred embodiment of the invention, simply by way of illustration of the best mode contemplated for carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

DETAILED DESCRIPTION OF THE PREFERRED EMBODIMENT

The present invention is an easel used to hold a plurality of containers of hair coloring solutions coordinated with a plurality of foils.

Figure 1:
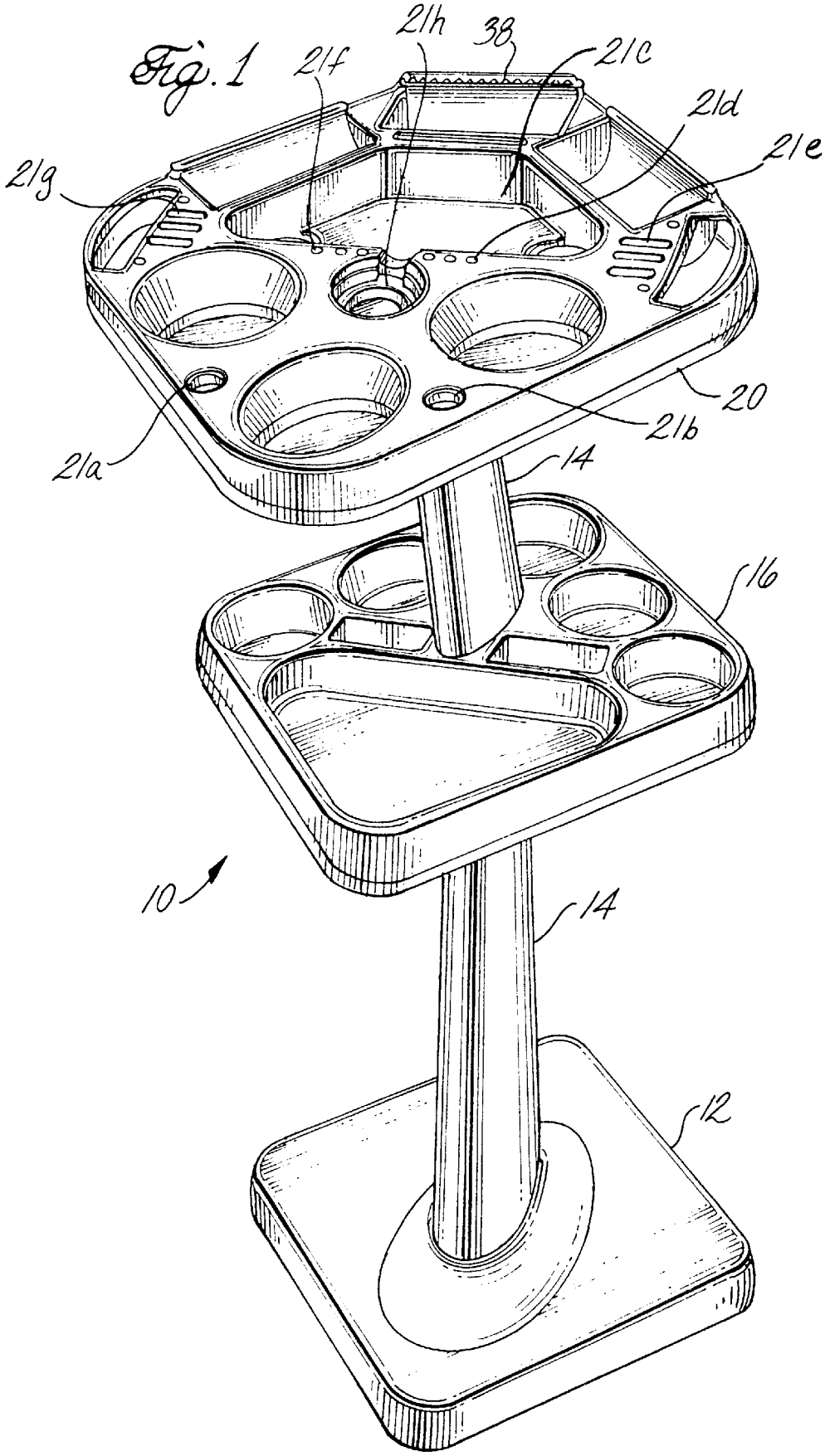
FIG. 1 is a perspective view of the hair coloring easel of the present invention.

FIG. 1 is a perspective view of one embodiment of the hair coloring easel of the present invention. The hair coloring easel 10 includes a base 12 situated on top of a plurality of wheels (not shown), a vertical support 14 coupled to the top center portion of the base 12, a utility tray 16 coupled to the middle of the vertical support 14, and a color tray 20 coupled to the top of the vertical support 14. Color tray 20 can be reverse mounted. In the preferred embodiment, the hair coloring easel 10 is made out of vacuum molded plastic, although other materials and methods of construction may also be used. The utility tray 16 includes a plurality of compartments, each compartment formed to hold one or more accessories used by a hair stylist, such as bleach and peroxide solution bottles, cream tube colors, liquid colors, hair clips, combs, brushes, and the like. In alternate embodiments, the utility tray may be omitted from the easel, and the color tray 20 may be used without the base 12 or vertical support 14 by placing the color tray on a table or counter.

Figure 2:
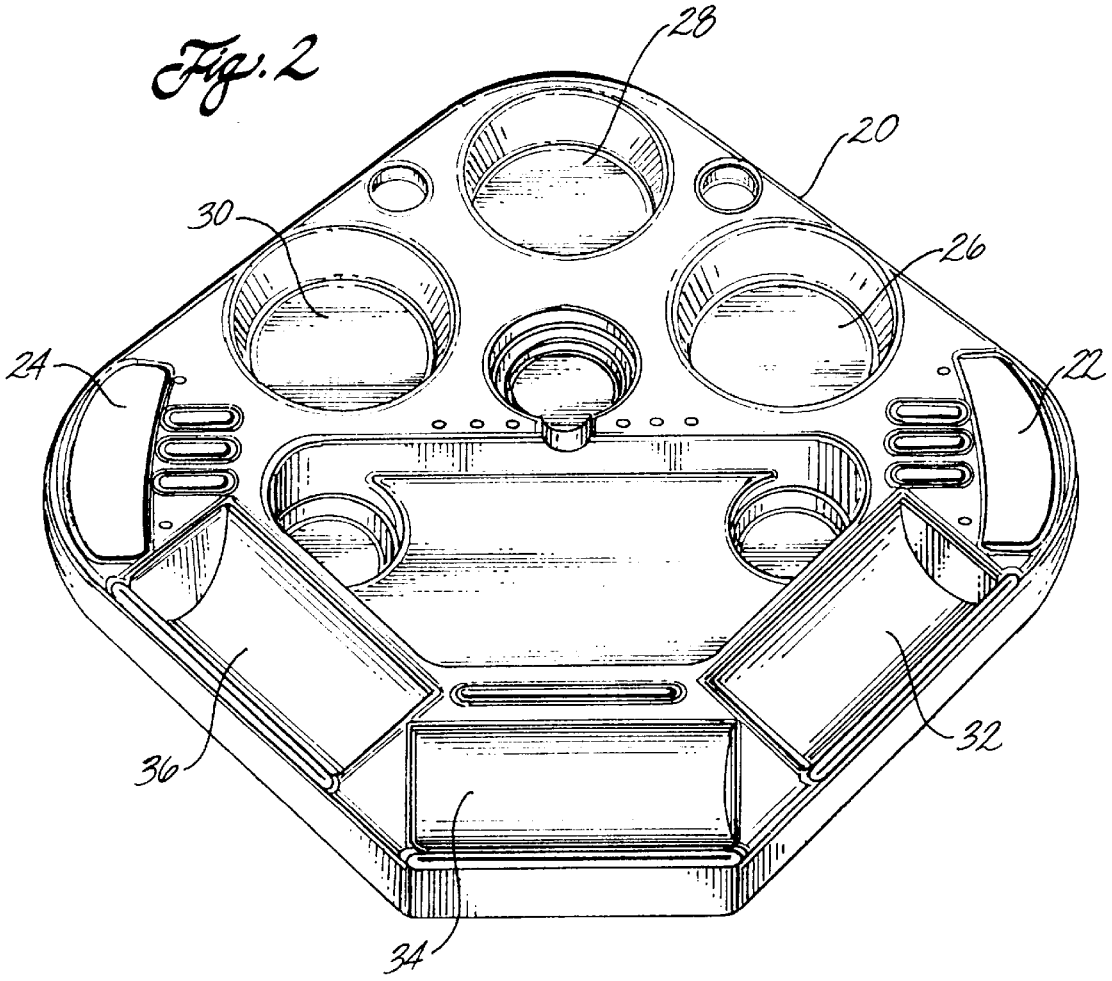
FIG. 2 is a top view of the color tray of the present invention.

FIG. 2 is a top view of the color tray of the present invention. The color tray 20 includes first and second handles 22, 24 molded or cut out of the color tray to allow for grasping of the hair coloring easel for lateral movement of the easel by the hair stylist during use. The color tray comprises a plurality of compartments for holding containers of hair coloring solutions or other liquids. The containers may be bottles, bowls, jars or other vessels. Hair coloring solutions are commonly stored during use in tint bowls (not shown in FIG. 2), and the solutions are applied to the customer's hair with tint brushes (not shown in FIG. 2). In the preferred embodiment, the color tray includes at least first 26, second 28, and third 30 hair coloring solution compartments, and matching first 32, second 34, and third 36 foil holding compartments, although other configurations with two or more hair coloring solution and foil holding compartments may be used.

Referring back to FIG. 1, along an outer top edge of each foil holding compartment is a foil ripper bar 38 (only one of which is shown in FIG. 1). The foil ripper bar 38 has a serrated edge used to detach individual foils from a roll of foil placed in the foil holding compartment. The foil is typically made out of aluminum, and preferably is colored. Preferably, the color tray 20 also includes a plurality of additional receptacles, recesses, compartments and openings 21*a*–21*h* for holding brushes, clips, and other items or utensils (not shown).

The present invention correlates hair coloring solution compartments and foil holding compartments according to their relative position and a predetermined reference indicia. Note in FIG. 2 that the first hair coloring solution compartment 26 is adjacent the first foil holding compartment 32, the second hair coloring solution compartment 28 is across from the second foil holding compartment 34, and the third hair coloring solution compartment 30 is adjacent the third foil holding compartment 36. In addition, the correlated compartments may have a unique indicia molded into, imprinted or written on the top surface of the color tray (for example, "A", "B" and "C") to indicate the hair coloring solution and foil holding compartment pairs.

Figure 3:
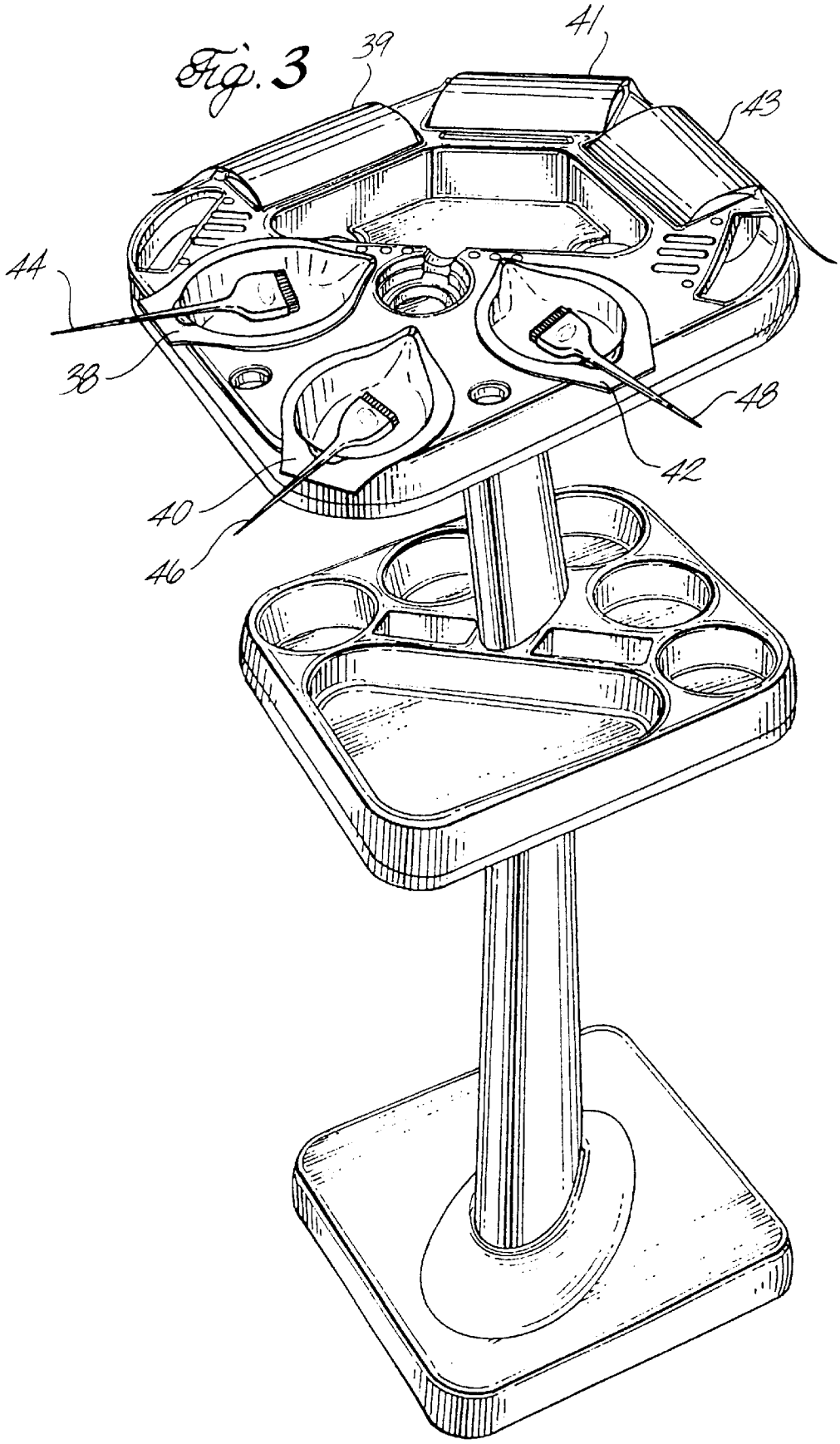
FIG. 3 is a top view of the color tray of FIG. 2 with tint bowls in the hair coloring solution compartments.

The indicia may also take the form of color coordinated compartments, wherein the hair coloring solution and foil holding compartment pairs are each of a different color, thereby providing an easily detectable distinction between the different hair coloring solution compartments and the foil holding compartments. Tint bowls are commonly used to hold the hair coloring solutions in the hair coloring solution compartments. FIG. 3 is a top view of the color tray of FIG. 2 with tint bowls in the hair coloring solution compartments. The tint bowls 38, 40, 42 and associated foils can have the same color as the respective hair coloring compartments 26, 28, and 30. For example, the first hair coloring solution compartment 26 and/or the first tint bowl 38 may be colored red. Accordingly, the first foil holding compartment 32 and/or the foils 39 stored therein are also red. The second hair coloring solution compartment 28 and/or the second tint bowl 40 may be colored yellow. The second foil holding compartment 34 and/or the foils 41 stored therein are also yellow. Finally, the third hair coloring solution compartment 30 and/or the third tint bowl 42 may be colored blue. The third foil holding compartment 36 and/or the foils 43 stored therein are also blue. Tint brushes 44, 46, and 48 may be located in the first, second, and third tint bowls, respectively, for application of the hair coloring solutions contained therein. Preferably, the tint brushes are coordinated (by color or other indicia) to their respective hair coloring solution compartments and/or tint bowls. Additional compartments and foils can be similarly coordinated, as can the tint brushes or other implements used to apply hair coloring solutions.

Hence, because the compartments are correlated according to relative position and reference indicia such as color, the present invention is easier to use than prior easels. The hair stylist can easily recognize and access different hair coloring solutions on the color tray of the easel due to its novel design. This feature helps the hair stylist to evenly apply multiple hair coloring solutions to the customer's hair.

For example, the hair stylist starts by applying a first hair coloring solution stored in a red-colored first tint bowl in the red-colored first hair coloring solution compartment to a first lock of the customer's hair. The hair stylist wraps this lock of hair in a piece of foil obtained from the red foil stored in the red first foil holding compartment. The hair stylist then applies a second hair coloring solution stored in a yellow-colored second tint bowl in the yellow-colored second hair coloring solution compartment to a second lock of the customer's hair. The hair stylist wraps this lock of hair in a piece of foil obtained from the yellow foil stored in the yellow second foil holding compartment. The hair stylist then applies a third hair coloring solution stored in a blue-colored third tint bowl in the blue-colored third hair coloring solution compartment to a third lock of the customer's hair. The hair stylist wraps this lock of hair in a piece of foil obtained from the blue foil stored in the blue third foil holding compartment. These steps are repeated until the customer's hair is covered as desired by different colored foils. The colored foils assist the hair stylist in keeping track of which hair coloring solutions have been applied to various locks of the customer's hair. Of course, different numbers of hair coloring solution compartments and foil holding compartments, and associated color combinations, may also be used.

The invention has been described in its presently contemplated best mode, and it is clear that it is susceptible to various modifications, modes of operation and embodiments, all within the ability and skill of those skilled in the art and without the exercise of further inventive activity. Accordingly, what is intended to be protected by Letters Patent is set forth in the appended claims.

What is claimed is:

1. A color tray for hair coloring, comprising:

a plurality of hair coloring solution compartments; and a plurality of foil holding compartments;

wherein selected ones of said plurality of hair coloring solution compartments are correlated to selected ones of said foil holding compartments according to a predetermined indicia.

2. The color tray of claim 1, wherein the number of hair coloring solution compartments equals the number of foil holding compartments, each hair coloring solution compartment being paired with a foil holding compartment.

3. The color tray of claim 1, wherein said predetermined indicia is color.

4. The color tray of claim 1, further comprising a plurality of bowls resident in said plurality of hair coloring solution compartments, each of the bowls being a distinct color; and a plurality of foil materials resident in said plurality of foil holding compartments; wherein the color of a selected one of said plurality of foil materials matches the color of a selected one of said plurality of bowls thereby correlating one of said plurality of hair coloring solution compartments to one of said foil holding compartments.

5. The color tray of claim 1, further comprising a plurality ol foil ripper bars each foil ripper bar coupled to a top edge of one of said plurality of foil holding compartments.

6. A hair coloring easel comprising:

a base;

a vertical support coupled to the base; and a tray coupled to the vertical support, said tray comprising a plurality of hair coloring solution compartments; and a plurality of foil holding compartments;

wherein selected ones of said plurality of hair coloring solution compartments are correlated to selected ones of said foil holding compartments according to a predetermined indicia.

7. The hair coloring easel of claim 6, wherein the number of hair coloring solution compartments equals the number of foil holding compartments, each hair coloring solution compartment being paired with a foil holding compartment.

8. The hair coloring easel of claim 6, wherein said predetermined indicia is color.

9. The hair coloring easel of claim 8, further comprising a plurality of bowls resident in said plurality of hair coloring solution compartments, each of the bowls being a distinct color; and a plurality of foil materials resident in said plurality of foil holding compartments; wherein the color of a selected one of said plurality of foil materials matches the color of a selected one of said plurality of bowls, thereby correlating one of said plurality of hair coloring solution compartments to one of said foil holding compartments.

10. The hair coloring easel of claim 6, further comprising a plurality of foil ripper bars, each foil ripper bar coupled to a top edge of one of said plurality of foil holding compartments.

11. A color tray for a hair coloring easel comprising:

a plurality of hair coloring solution compartments;

a plurality of tint bowls, each tint bowl residing in a selected one of the plurality of hair coloring solution compartments and being a distinct color; and a plurality of foil holding compartments;

wherein selected ones of said plurality of tint bowls are correlated to selected ones of said foil holding compartments according to color.

12. A color tray for a hair coloring easel comprising:

a first hair coloring solution compartment;

a second hair coloring solution compartment;

a third hair coloring solution compartment;

a first foil holding compartment;

a second foil holding compartment; and a third foil holding compartment;

wherein said first hair coloring solution compartment is correlated to said first foil holding compartment, said second hair coloring solution compartment is correlated to said second foil holding compartment, and said third hair coloring solution compartment is correlated to said third foil holding compartment according to color.

13. The color tray of claim 12, further comprising:

a first tint bowl resident in said first hair coloring solution compartment and being a first color;

a second tint bowl resident in said second hair coloring solution compartment and being a second color; and a third tint bowl resident in said third hair coloring solution compartment and being a third color; and a first supply of foil material resident in said first foil holding compartment, wherein the color of said first supply of foil material matches said first color of said first tint bowl, thereby correlating said first hair coloring solution compartment to said first foil holding compartment;

a second supply of foil material resident in said second foil holding compartment, wherein the color of said second supply of foil material matches said second color of said second tint bowl, thereby correlating said second hair coloring solution compartment to said second foil holding compartment; and a third supply of foil material resident in said third foil holding compartment, wherein the color of said third supply of foil material matches said third color of said third tint bowl, thereby correlating said third hair coloring solution compartment to said third foil holding compartment.

14. A kit for coordinating a plurality of hair coloring solutions, comprising:

a color tray including a plurality of hair coloring solution compartments;

a plurality of foil holding compartments;

a plurality of tint bowls, each tint bowl residing in a selected one of the plurality of hair coloring solution compartments and being a distinct color; and a plurality of tint brushes;

wherein selected ones of said plurality of tint bowls and said tint brushes are correlated to selected ones of said foil holding compartments according to color.

15. The kit of claim 14, further comprising:

a plurality of foil materials resident in said plurality of foil holding compartments, wherein the color of a selected one of said plurality of foil materials matches the color of a selected one of said plurality of tint bowls, thereby correlating one of said plurality of hair coloring solution compartments to one of said foil holding compartments.

16. A method of applying color to a customer's hair using a plurality of hair coloring solutions stored in a hair coloring easel, the hair coloring easel having a plurality of hair coloring solution compartments, each holding a colored tint bowl storing a selected hair coloring solution, and a plurality of foil holding compartments, each holding colored foil material, the color of a selected tint bowl matching the color of a selected foil material, the method comprising the steps of:

(a) applying a first hair coloring solution to a first lock of the customer's hair from a first colored tint bowl resident in a first hair coloring solution compartment;

(b) obtaining a first foil material from a first foil holding compartment correlated to said first hair coloring solution compartment;

(c) wrapping said first lock of hair with said first foil material;

(d) applying a second hair coloring solution to a second lock of the customer's hair from a second colored tint bowl resident in a second hair coloring solution compartment;

(e) obtaining a second foil material from a second foil holding compartment correlated to said second hair coloring solution compartment; and (f) wrapping said second lock of hair with said second foil material.

* * * * *

UNITED STATES PATENT AND TRADEMARK OFFICE

CERTIFICATE OF CORRECTION

PATENT NO. : 5,819,960

DATED : October 13, 1998

INVENTOR(S) : Claudio Bonazza

It is certified that error appears in the above-identified patent and that said Letters Patent is hereby corrected as shown below:

Column 5, line 9, change "ol" to -- of --.

Signed and Sealed this

Twelfth Day of October, 1999

*Attest:*

Q. TODD DICKINSON

*Attesting Officer*

*Acting Commissioner of Patents and Trademarks*